United States Patent [19]

Herndon

[11] Patent Number: 4,738,061

[45] Date of Patent: Apr. 19, 1988

[54] FOUNDATION SYSTEM FOR MANUFACTURED HOMES

[76] Inventor: Thomas W. Herndon, 2913 N. Alhambra #3, Roswell, N. Mex. 88201

[21] Appl. No.: 726,490

[22] Filed: Apr. 24, 1985

[51] Int. Cl.[4] ..... E02D 27/32; B60R 27/00

[52] U.S. Cl. ..... 52/126.6; 52/169.12; 52/299; 52/302; 52/DIG. 3

[58] Field of Search ..... 52/521, 126.5, 23, DIG. 11, 52/79.1, 143, DIG. 3, 292, 299, 742, 294, 126.6, 274, 302

[56] References Cited

U.S. PATENT DOCUMENTS

| | | | |
|---|---|---|---|
| 2,138,958 | 12/1938 | Corbett | 52/294 |
| 2,709,402 | 5/1955 | Malm | 52/302 |
| 2,743,602 | 5/1956 | Dunn | 52/274 |
| 2,791,463 | 5/1957 | Levitt | 52/521 |
| 2,990,588 | 7/1961 | McKinley | 52/292 |
| 3,220,079 | 11/1965 | Aggson | 52/307 |
| 3,256,655 | 6/1966 | Teeter | 52/169.12 |
| 3,562,983 | 2/1971 | Rector | 52/DIG. 3 |
| 3,605,350 | 9/1971 | Bowers | 52/274 |
| 3,664,082 | 5/1972 | Zintel | 52/742 |
| 3,713,259 | 1/1973 | Tkach | 52/126.5 |
| 3,722,156 | 3/1973 | Bryant . | |
| 3,753,323 | 8/1973 | Nesbitt . | |
| 3,775,917 | 12/1973 | Struben . | |
| 3,827,201 | 8/1974 | Struben . | |
| 3,828,491 | 8/1974 | Koon | 52/23 |
| 3,830,024 | 8/1974 | Warnke | 52/23 |
| 3,885,364 | 5/1975 | Lankheet | 52/102 |
| 3,977,199 | 8/1976 | Chiaves . | |
| 4,007,568 | 2/1977 | Soble | 52/294 |
| 4,009,542 | 3/1977 | Houston | 52/299 |
| 4,010,584 | 3/1977 | Barnes | 52/DIG. 3 |
| 4,043,088 | 8/1977 | Payton . | |
| 4,261,149 | 4/1981 | Gustafson | 52/DIG. 11 |
| 4,263,762 | 4/1981 | Reed | 52/169.1 |
| 4,400,919 | 8/1983 | Szabo | 52/169.12 |
| 4,443,981 | 4/1984 | Weiss | 52/169.1 |
| 4,512,120 | 4/1985 | Lindar | 52/79.1 |
| 4,546,581 | 10/1985 | Gustafson | 52/23 |

*Primary Examiner*—John E. Murtagh

*Attorney, Agent, or Firm*—Richards, Harris, Medlock & Andrews

[57] ABSTRACT

A foundation system is provided for permanently installing manufactured homes on footings set into the ground. Vertical support members are mounted on the footings at ground level. Attached to the top of each vertical support member is a vertically adjustable load bearing plate which provides support for the frame of the house. The bearing plate includes means for engaging a longitudinal frame member on the underside of the house to anchor the house securely to the footing. In addition, the foundation system includes overlapping corrosion resistant fiberglass panels attachable to the base perimeter of the house. The panels are constructed with vertical ribs to provide strength for defining a retaining wall against backfilling around the outside perimeter of the house.

8 Claims, 2 Drawing Sheets

FIG. 3
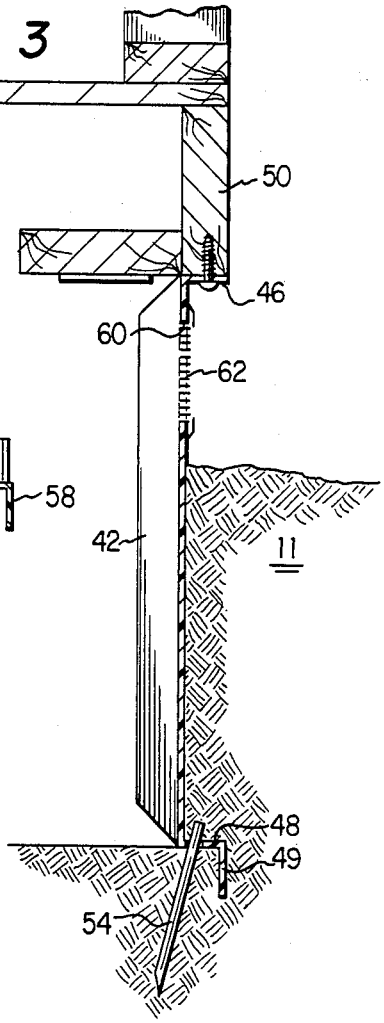
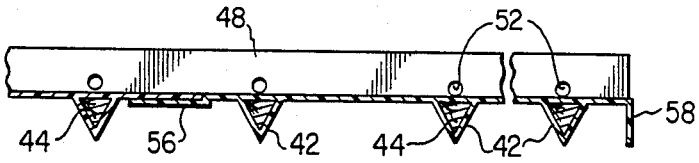
FIG. 5
FIG. 4
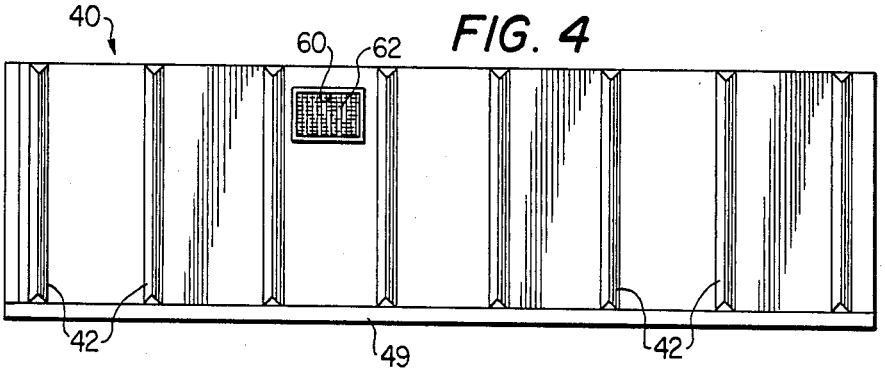

FOUNDATION SYSTEM FOR MANUFACTURED HOMES

TECHNICAL FIELD

This invention relates to foundations for manufactured or mobile homes, and more particularly to a permanent frame support and hold down system, including a perimeter foundation system to shore against backfilling around the foundation.

BACKGROUND OF THE INVENTION

Manufactured homes were developed to provide prospective homeowners with an affordable alternative to conventional homes which have been priced out of the reach of many families. Manufactured homes are similar to mobile homes in that they are built on longitudinal support frames so that they may be subsequently transported to a suitable housing site.

However, manufactured homes differ from mobile homes in the desire to support manufactured homes at ground level to give the appearance of site build homes.

Although manufactured homes are generally designed for permanent installation at a housing site, they suffer from many of the foundational problems associated with mobile homes. Mobile homes supported by concrete blocks or jacks have always been highly vulnerable to damage or destruction by high winds even when tie-downs are used. The open space beneath mobile homes allows excessive air circulation which can cause drafts and a dangerous lifting effect in strong winds. Furthermore, the open space can allow trash to drift in and collect beneath the home, causing a health and fire hazard as well as an unsightly appearance.

Mobile homes can be provided with skirting to shield the open area beneath the home from the weather. To be effective and satisfactory, mobile home skirting must be adjustable to variations in the height of the home from the ground and it must be easily removed and stored when the mobile home is prepared for transport. These requirements have led to skirting which is structurally complex, expensive, difficult to install, and often unsightly. These prior art skirting systems have generally proven unsatisfactory when used with manufactured homes at a permanent installation in a ground level installation.

Currently there are at least four acceptable methods for installing and enclosing manufactured homes which qualify for financing under federal codes. First, a poured concrete perimeter foundation with concrete block walls. Second, an enclosure constructed of marine plywood framed with two-by-fours. Third, an enclosure constructed of galvanized corrugated steel. Fourth, an enclosure constructed of poured concrete reinforced stem walls. The first method is very expensive; the second method is comparatively inexpensive but will not last for the life of the house; the third and fourth methods are expensive, difficult to install, and unattractive. In addition, all of these methods require a separate frame support system for mounting the house.

Thus, it can be seen that there is a need for a permanent foundation system for manufactured homes in a ground level set which combines approved ground preparation with a package of components which satisfies all structural requirements. Such a foundation system must meet federal codes, must effectively secure the home, and must be suitable for permanent installation for the life of the home.

SUMMARY OF THE INVENTION

The present invention is a system which combines and integrates the components necessary to provide a permanent foundation for a manufactured home. The system comprises support members for the frame of the house, which also serve to anchor the house in place, and enclosure panels which permit backfilling around the perimeter of the house.

The foundation system of the present invention utilizes a plurality of concrete pier footings or spread footings, depending upon the type of soil and the local building code requirements. The footings are set into the ground so that the house can be installed substantially at ground level. The footings are provided with anchor bolts at the top for securely mounting a plurality of vertical frame support members which secure the house to the footings.

Each frame support member includes a base plate which bolts to the footing. Attached to the base plate is a vertical support member. Attached to the top of the vertical support member is a vertically adjustable load bearing plate which supports a longitudinal frame member on the underside of the house. The bearing plate includes means, such as clamping plate, for engaging the longitudinal frame member to secure the house in place.

As part of the complete foundation system, the present invention includes a plurality of overlapping enclosure panels which are installed at the base of the house so that soil may be backfilled against the panels around the outside perimeter of the house. In the preferred embodiment, the panels are constructed of corrosion resistant fiberglass reinforced plastic with vertical ribs for added strength. The fiberglass panels are designed for long life, easy installation, aesthetic appearance, protection against wind and water, and strength to support the backfilled soil.

The foundation system of the present invention provides an integrated package of components which are easy to install without special tools using unskilled labor, which provide an effective means for securing a manufactured home without additional tie-downs or perimeter load bearing walls, which are essentially maintenance-free, which have a long life and pleasing appearance, and which can be provided at a lower cost than other available systems.

BRIEF DESCRIPTION OF THE DRAWINGS

For a more complete understanding of the present invention and for further advantages thereof, reference is now made to the following Description of the Preferred Embodiments taken in conjunction with the accompanying Drawings, in which:

FIG. 3 illustrates the use of a rigid panel of the foundation system to act as a retaining wall against backfilling around the outside perimeter of the house;

FIG. 4 is a view of the inward facing side of a rigid panel; and

FIG. 5 is a cross-sectional view of two adjacent panels showing their construction and their overlap upon installation.

DESCRIPTION OF THE PREFERRED EMBODIMENTS

Figure 1:
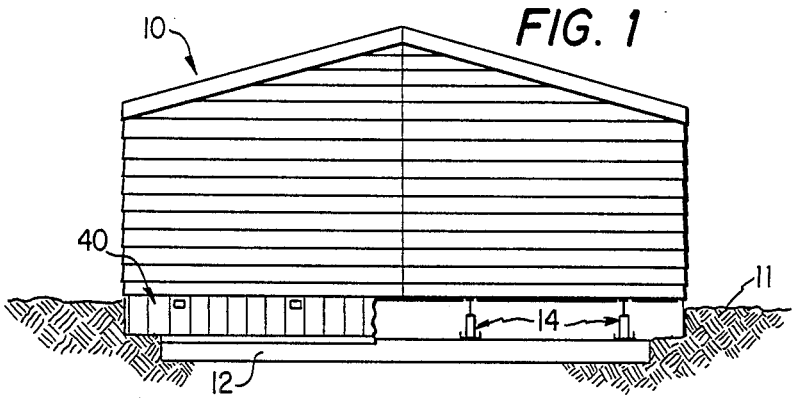
FIG. 1 illustrates a manufactured home mounted at ground level on the foundation system of the present invention.

Referring to FIG. 1, a manufactured house, generally identified by the numeral 10, is shown mounted on the foundation system of the present invention. A concrete footing 12 is shown set into the ground. Mounted on the footing 12 are a plurality of frame support members 14 which support and secure the house to the footing 12. Rigid panels 40 are attached to the base of the house 10 to form a retaining wall against backfilling of earth 11 around the perimeter of the house to support the house at ground level as seen in FIG. 1 to give the appearance of a site built home.

Figure 2:
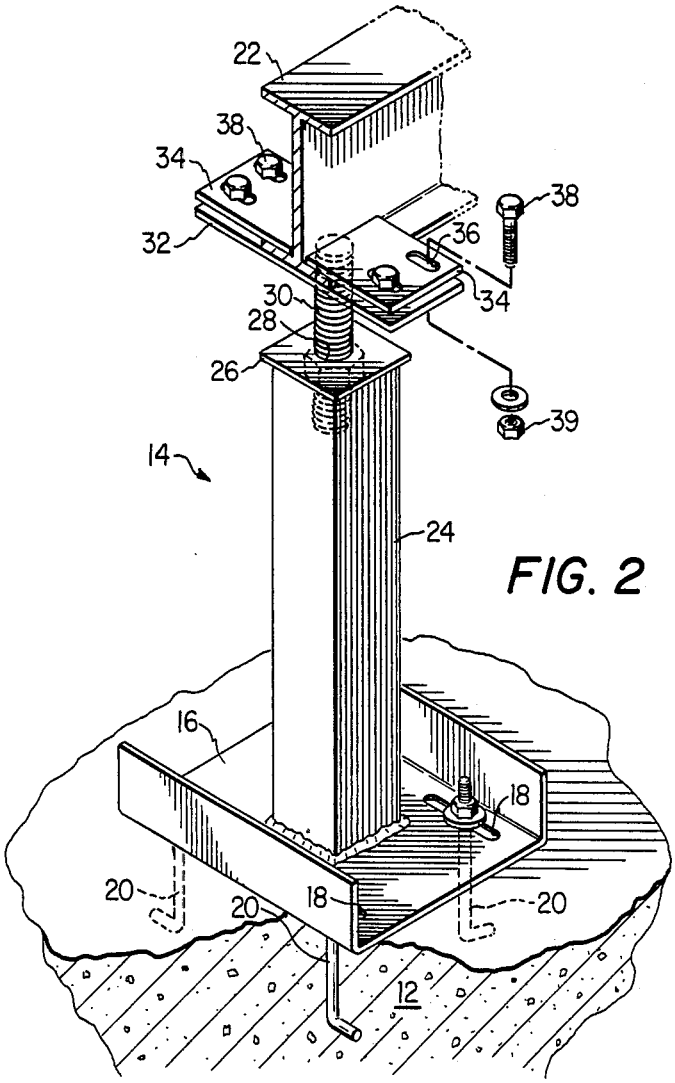
FIG. 2 illustrates a vertical frame support member of the present invention, including the load bearing and clamping plates used to support and secure a longitudinal frame member of the house.

A perspective view of a frame support member 14 is shown in FIG. 2. A base plate 16 having slots 18 is securely mounted on footing 12 by means of anchor bolts 20 set in the footing 12. The anchor bolts 20 pass through the slots 18 which are oriented in a direction perpendicular to a longitudinal frame member 22 of the house 10 to provide adjustment so that the frame support member 14 may be positioned directly below the longitudinal frame member 22. Attached to base plate 16 is a vertical support member 24, which may consist of a length of structural steel tubing having a square cross-sectional area. Attached to the top of vertical support member 24 is a top plate 26 having a threaded hole 28 for receiving a threaded rod 30. The threaded rod 30 provides vertical adjustment for a load bearing plate 32 attached to the top of threaded rod 30. Load bearing plate 32 provides support for longitudinal frame member 22, typically a steel I-beam. Clamping plates 34 having slots 36 are designed to be positioned tightly against each side of longitudinal frame member 22 and secure the lower portion thereof between the load bearing plate 32 and the clamping plates 34. Tightening bolts 38 extend through slots 36 and corresponding slots in load-bearing plate 32 and are secured by nuts 39. The slots 36 allow clamping plates 34 to be adjusted tightly against longitudinal frame member 22.

FIGS. 3, 4, and 5 illustrate the panels 40 which form a retaining wall against the earth 11 backfilled around the perimeter of the house. Panels 40 of the present invention are constructed of corrosion resistant fiberglass reinforced plastic (FRP). The fiberglass reinforcement may be in the form of mat laminate to provide strength and rigidity. Vertical reinforcing ribs 42 are spaced at about one-foot intervals along the panel 40. The vertical reinforcing ribs 42 are of FRP construction of triangular cross-section around non-structural wooden forms 44. Panels 40 include an outwardly extending flange 46 at the top for attaching the panel 40 to the base perimeter 50 of the house. Panels 40 also include a lower flange 48 having spaced apart holes 52 so that the bottom of panels 40 may be secured to the ground by spikes 54 driven through the holes 52. Thus secured, panels 40 form a retaining wall against earth 11 backfilled around the outside perimeter of the house 10. In addition, panels 40 can include a cleat 49 extending downwardly from the edge of lower flange 48. In one application, a cleat 49 extending downward one inch has been found effective. The cleat 49 will dig into the earth when backfilling is done to more rigidly fix the panel 40 to support the backfill. Also, in severe water intrusion environments where it is necessary to use a concrete footing, cleats 49 can be imbedded in the concrete for greater stability.

For ease of installation, aesthetic appearance, and weatherproofing, panels 40 include an offset edge 56 at one end to overlap an adjacent panel and provide a smooth seam. In addition, selected panels 40 may include a right-angle bend 58 at one end so that the panel may extend around a corner of the house 10. Selected panels 40 may also include an opening covered with corrosion resistant wire mesh 60 to provide ventilation for the crawl-spaced beneath the house 10.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A foundation system supported by underground footings for securing a manufactured house to the underground footings, said house having longitudinal frame members with the manufactured house at ground level, portions of the manufactured house extending outward from the longitudinal frame members to define the perimeter of the manufactured house, comprising:

a plurality of vertical support members mounted on the footings;

means attached to each of said vertical support members for engaging a longitudinal frame member on the underside of the manufactured house, said vertical support members supporting the house at ground level; and means attachable to the house along the perimeter of the house forming a reatining wall supporting backfill around the outside perimeter of the house to achieve a ground level installation of the house, said vertical support members carrying the entire load of the manufactured house with said retaining wall means acting solely to support backfill and provide a pleasing appearance to the exposed portions of the foundation system, the retaining wall means comprises a plurality of rigid panels attached around the base perimeter of the house, the rigid panels are constructed of corrosion resistant fiberglass reinforced plastic and further comprise:

a plurality of spaced apart vertical ribs on the inside surface;

a flange along the top and bottom edges of the panel for attaching the top of the panel to the base perimeter of the house and for securing the bottom of the panel to the ground below ground level; and an offset section at one end of the panel for overlapping an adjacent panel.

2. The foundation system of claim 1 wherein selected ones of the rigid panels further include a ventilation opening covered with corrosion resistant wire mesh.

3. The foundation system of claim 1 wherein selected ones of the rigid panels include a right-angle bend along a vertical line to allow the panel to extend around a corner of the house.

4. A foundation system for a manufactured house to support the house substantially at ground level comprising a plurality of rigid panels attachable to the base perimeter of the manufactured house to form a retaining wall against backfill around the outside perimeter of the manufactured house with the house to be substantially at ground level, the rigid panels acting solely as a retaining wall and to provide an attractive appearance to the exterior of the foundation system and not supporting the weight of the manufactured house, the rigid panels comprise:

a plurality of spaced apart vertical ribs on the inside surface; a flange along the top and bottom edges of the panel for attaching the top of the panel to the base perimeter of the house and for securing the bottom of the panel to the ground below ground level; and an offset section at one end of the panel for overlapping an adjacent panel.

5. The foundation system of claim 4 wherein the rigid panels are constructed of laminated fiberglass mat reinforced plastic and the vertical ribs are of said fiberglass reinforced plastic construction around forms having a triangular cross-section.

6. The foundation system of claim 4 wherein selected ones of the rigid panels further comprise a ventilation opening covered with corrosion resistant wire mesh.

7. The foundation system of claim 4 wherein selected ones of the rigid panels include a right-angle bend along a vertical line to allow the panel to extend around a corner of the house.

8. A foundation system supported by underground footings for securing a manufactured house having longitudinal frame members with the manufactured house substantially at ground level, said manufactured house having portions extending from the longitudinal frame members cantilevered outward from the frame members to define the outer perimeter of the house, comprising:

a plurality of frame supports mounted on the footings, each of said frame supports comprising a base plate for attaching said frame support to the footing, a vertical support member attached to the top of said base plate, a top plate attached to the top of said vertical support member and having a threaded hole therethrough, a threaded rod which screws into said threaded hole in said top plate, a bearing plate attached to the top of said threaded rod to provide a load bearing surface for a longitudinal frame member on the underside of the house, and means for clamping said bearing plate to said longitudinal frame member, said frame supports lying completely within the outer perimeter of the manufactured house; and a plurality of corrosion resistent fiberglass reinforced plastic panels attached to the base perimeter of the house to form a retaining wall against backfill around the outside perimeter of the house to permit the house to be substantially at ground level, the entire weight of the manufactured house being borne through said frame supports to the underground footings so that the fiberglass reinforced plastic panels act solely to support backfill and provide an attractive appearance to the exterior of the foundation system, each of said panels comprising a plurality of spaced apart vertical ribs having a triangular cross section, a flange along the top edge for attaching said panel to the base of the house, a flange along the bottom edge for securing the bottom of said panel to the ground, an offset section at one end of said panel for overlapping an adjacent panel, and, in selected one of said panels, a ventilation opening covered with corrosion resistent wire mesh.

* * * * *

UNITED STATES PATENT AND TRADEMARK OFFICE

CERTIFICATE OF CORRECTION

PATENT NO. : 4,738,061

DATED : April 19, 1988

INVENTOR(S) : Thomas W. Herndon

It is certified that error appears in the above-identified patent and that said Letters Patent is hereby corrected as shown below:

Column 4, line 34, change "reatining" to --retaining--.

Signed and Sealed this

Eighteenth Day of April, 1989

*Attest:*

DONALD J. QUIGG

*Attesting Officer*

*Commissioner of Patents and Trademarks*